United States Patent [19]

Wetherington

[11] 4,376,520

[45] Mar. 15, 1983

[54] BAG STAND

[76] Inventor: Nelson A. Wetherington, 167 Ridge Rd., NW., Largo, Fla. 33540

[21] Appl. No.: 299,674

[22] Filed: Sep. 8, 1981

[51] Int. Cl.[3] ..... A63B 55/04

[52] U.S. Cl. ..... 248/97; 248/150

[58] Field of Search ..... 248/97, 95, 98, 99, 248/100, 101, 150; 53/384, 390

[56] References Cited

U.S. PATENT DOCUMENTS

| | | | |
|---|---|---|---|
| 478,913 | 7/1892 | Bratney | 248/99 |
| 1,414,575 | 5/1922 | McCart | 248/101 X |
| 2,503,118 | 4/1950 | Mannix | 248/100 |
| 3,180,384 | 4/1965 | Seifert | 248/95 X |
| 3,614,041 | 10/1971 | Koger | 248/101 X |
| 3,893,649 | 7/1975 | Cornell | 248/101 X |
| 4,223,862 | 9/1980 | Doughty | 211/105.1 X |
| 4,280,676 | 7/1981 | Betts | 248/97 |

FOREIGN PATENT DOCUMENTS

| | | | |
|---|---|---|---|
| 554881 | 7/1943 | United Kingdom | 248/95 |

*Primary Examiner*—J. Franklin Foss

*Attorney, Agent, or Firm*—Stanley M. Miller

[57] ABSTRACT

A bag stand is disclosed for supporting the upper edge of a plastic, cloth or paper bag at a convenient height to facilitate filling the bag with raked leaves, grass clippings, or the like. The stand includes a base ring with a generally circular shape with a V-shaped circumferential groove in its periphery. The bag has its upper edge passing up through the open center of the base ring, laying over the top of the base ring and draping down over the periphery thereof. An elastic ring of V-shaped cross section is adapted to fit over the periphery of the base ring, compressing the draped portion of the bag into the circumferential groove of the base ring, frictionally retaining it. A plurality of support flanges are integrally formed with the base ring and depend downwardly and outwardly from it at an angle of approximately five degrees with respect to the vertical. Each flange has a vertical slot in it which opens into an upper horizontal slot. A plurality of support legs are provided, one for each flange, each having a stud projecting from it which slideably engages in the respective vertical slot and locks into the upper horizontal slot of the respective support flange. The outward inclination of each flange imparts a corresponding outward inclination to the respective support leg mounted to it, thereby improving the stability of the bag stand. The legs are easily mounted or removed from the base ring providing for a quick set-up of the bag stand to assist in yard work, followed by a convenient compact storage in its disassembled form.

3 Claims, 4 Drawing Figures

FIG. 1
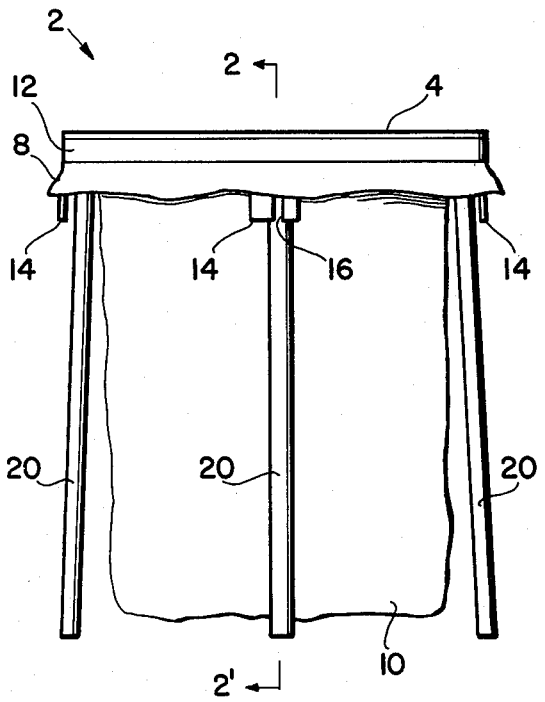
FIG. 2
SEC. 2-2'
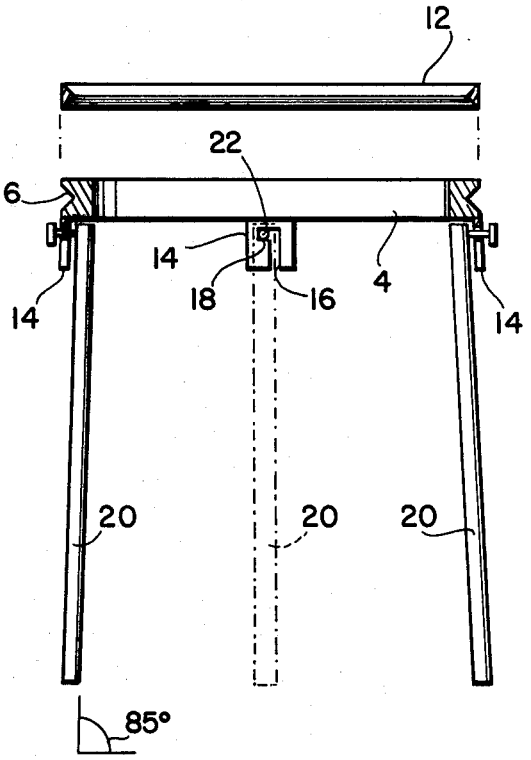
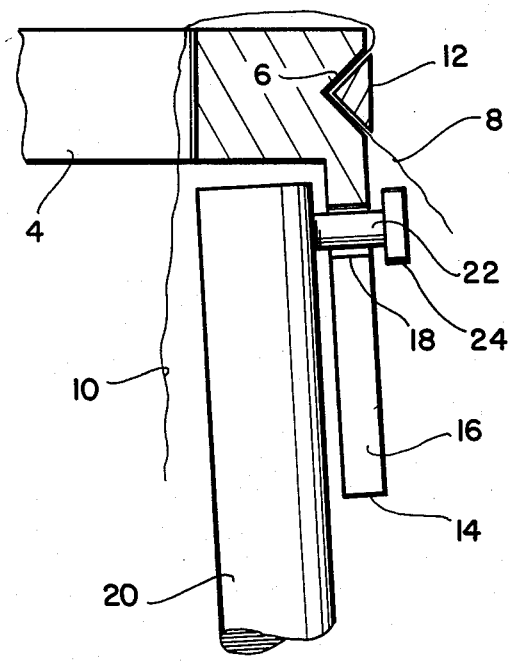
FIG. 3
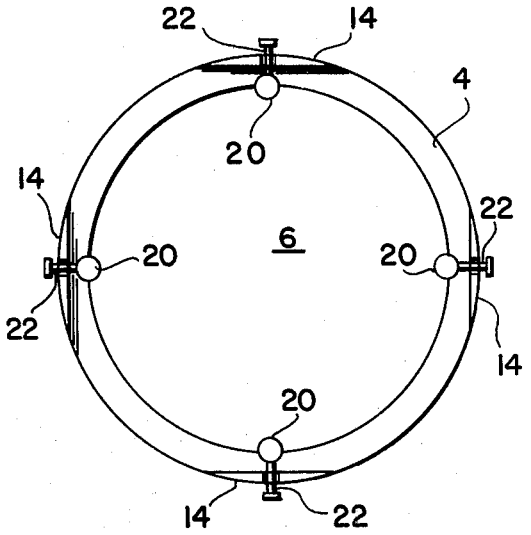
FIG. 4

BAG STAND

FIELD OF THE INVENTION

The invention disclosed broadly relates to receptacles and more particularly pertains to an improved bag stand.

BACKGROUND OF THE INVENTION

The collection and disposal of raked leaves and grass clippings is a common component of domestic yard work. It is typically a two-person task, one person holding a plastic bag in an open position while the other person gathers and deposits the leaves or grass clippings. What is needed is an improved bag stand which can be quickly and easily assembled in the yard, which will hold the plastic bag in an open, upright position at a convenient height, is stable in its support of the bag, and which can be easily disassembled and stored in a compact form when the task is completed.

OBJECTS OF THE INVENTION

It is therefore an object of the invention to provide an improved bag stand which is easily assembled, is stable in its support of the bag, and which stores away in a compact form.

SUMMARY OF THE INVENTION

These and other objects, features and advantages of the invention are accomplished by the bag stand disclosed herein. A bag stand is disclosed for supporting the upper edge of a plastic, cloth or paper bag at a convenient height to facilitate filling the bag with raked leaves, grass clippings, or the like. The stand includes a base ring with a generally circular shape with a V-shaped circumferential groove in its periphery. The bag has its upper edge passing up through the open center of the base ring, laying over the top of the base ring and draping down over the periphery thereof. An elastic ring of V-shaped cross section is adapted to fit over the periphery of the base ring, compressing the draped portion of the bag into the circumferential groove of the base ring, frictionally retaining it. A plurality of support flanges are integrally formed with the base ring and depend downwardly and outwardly from it at an angle of approximately five degrees with respect to the vertical. Each flange has a vertical slot in it which opens into an upper horizontal slot. A plurality of support legs are provided, one for each flange, each having a stud projecting from it which slideably engages in the respective vertical slot and locks into the upper horizontal slot of the respective support flange. The outward inclination of each flange imparts a corresponding outward inclination to the respective support leg mounted to it, thereby improving the stability of the bag stand. The legs are easily mounted or removed from the base ring providing for a quick set-up of the bag stand to assist in yard work, followed by a convenient compact storage in its disassembled form.

DESCRIPTION OF THE FIGURES

These and other objects, features and advantages of the invention will be more fully appreciated with reference to the accompanying drawings.

FIG. 1 shows a front view of the invention.

FIG. 2 is a cross sectional view along the section line 2—2' of FIG. 1.

FIG. 3 is a detailed view of the base ring shown in FIG. 2.

FIG. 4 is a bottom view of the invention.

DISCUSSION OF THE PREFERRED EMBODIMENT

A bag stand 2 is shown in FIGS. 1 through 4 for supporting the upper edge of a plastic, cloth or paper bag 10 at a convenient height to facilitate filling the bag with raked leaves, grass clippings, or the like. The stand 2 includes a base ring 4 with a generally circular shape with a V-shaped circumferential groove 6 in its periphery. The bag 10 has its upper edge 8 passing up through the open center 6 of the base ring 4, laying over the top of the base ring 4 and draping down over the periphery thereof.

An elastic ring 12 of V-shaped cross section is adapted to fit over the periphery of the base ring 4, compressing the draped portion 8 of the bag 10 into the circumferential groove 6 of the base ring 4, frictionally retaining it.

A plurality of support flanges 14 are integrally formed with the base ring 4 and depend downwardly and outwardly from it at an angle of approximately five degrees with respect to the vertical. Each flange 14 has a vertical slot 16 in it which opens into an upper horizontal slot 18. A plurality of support legs 20 are provided, one for each flange 14, each having a stud 22 projecting from it which slideably engages in the respective vertical slot 16 and locks into the upper horizontal slot 18 of the respective support flange 14. The outward inclination of each flange 14 imparts a corresponding outward inclination to the resepctive support leg 20 mounted to it, thereby improving the stability of the bag stand 2.

The legs 20 are easily mounted or removed from the base ring 4 providing for a quick set-up of the bag stand 2 to assist in yard work, followed by a convenient compact storage in its disassembled form.

The horizontal base ring 4 has a generally circular annular shape, with a V-shaped circumferential groove 6 in the periphery thereof, the base ring 4 having a central opening 6 up through which passes the upper edge 8 of the plastic bag 10 which lays over the top of said base ring 4 and drapes down over the periphery thereof, covering the circumferential groove 6.

The elastic ring 12 of V-shaped cross section is adapted to fit over the downwardly draped portion 8 of the pastic bag 10, compressing the bag 10 into the circumferential groove 6 of the base ring 4, for the frictional retention thereof.

The plurality of support flanges 14 are integrally formed with the base ring 4 and depend downwardly and outwardly therefrom at an angle of approximately five degrees with respect to the vertical. Each flange 14 has a vertical slot 16 therein which opens into an upper horizontal slot 18.

Each of the plurality of support legs 20, one for each of the plurality of flanges 14, has a stud 22 projecting from the side thereof, which slideably engages the respective vertical slot 16 and locks into the upper horizontal slot 18 of the respective support flange 14. The plurality of support legs 20 depend downwardly and outwardly from the base ring 4 at an angle of approximately five degrees with respect to the vertical, supporting the upper edge of the plastic bag 10 at a convenient elevated position on the base ring 4.

The base ring 4 and integrally formed support flanges 14 are molded as a single unit from a plastic material such as polypropylene.

The elastic ring 12 is composed of an elastomeric material such as rubber.

The stud 22 on each respective leg 20 has a head portion 24 for retaining the stud 22 within the respective slots 16 and 18 in the respective flange 14.

The resultant bag stand is light weight, is easily assembled, is stable in its support of the bag, and is capable of storage in a compact form. It can be used to support cloth or paper bags as well as plastic bags.

Although a specific embodiment of the invention has been disclosed, it will be understood by those of skill in the art that changes may be made in the form or composition of the disclosed embodiment without departing from the spirit and the scope of the invention.

What is claimed is:

1. A bag stand, comprising:

a horizontal base ring having a generally circular annular shape, with a V-shaped circumferential groove in the periphery thereof, said base ring having a central opening up through which passes the upper edge of a bag which lays over the top of said base ring and drapes down over the periphery thereof, covering said circumferential groove;

an elastic ring of V-shaped cross section composed of an elastomeric material, adapted to fit over said downwardly draped portion of said bag, compressing the bag into said circumferential groove of said base ring, for the frictional retention thereof;

a plurality of support flanges integrally formed with said base ring and molded as a single unit with said base ring from a plastic material, and depending downwardly and outwardly therefrom at an angle of approximately five degrees with respect to the vertical, each said flange having a vertical slot therein which opens into an upper horizontal slot;

a plurality of support legs, one for each of said plurality of flanges, each having a stud projecting from the side thereof, which slideably engages said respective vertical slot and locks into said upper horizontal slot of the respective support flange, each said stud having a head portion for retaining said stud within the respective slots in the respective flange, said plurality of support legs depending downwardly and outwardly from said base ring at an angle of approximately five degrees with respect to the vertical, supporting said upper edge of said bag at a convenient elevated position on said base ring.

2. The bag stand of claim 1, wherein said base ring is composed of polypropylene.

3. The bag stand of claim 2, wherein said elastic ring is composed of rubber.

* * * * *